United States Patent [19]

Burnside

[11] 4,191,377

[45] Mar. 4, 1980

[54] INDEXING MEANS FOR ROTATING DRUMS OF AMUSEMENT APPARATUS

[75] Inventor: Walter M. Burnside, Waukegan, Ill.

[73] Assignee: Bally Manufacturing Corporation, Chicago, Ill.

[21] Appl. No.: 892,671

[22] Filed: Apr. 3, 1978

[51] Int. Cl.[2] ..... A63F 5/04

[52] U.S. Cl. ..... 273/143 R; 74/577 S

[58] Field of Search ..... 273/143 R, 143 A, 143 B, 273/143 C, 143 D, 143 E, 141 A, 142 R, 142 A, 142 B, 142 C, 142 D, 142 E, 142 F, 142 G, 142 H, 142 HA, 142 J, 142 JA, 142 JB, 142 JC, 142 JD, 142 K; 58/116 R, 116 M, 7; 74/575, 576, 577 R, 577 S, 577 SF, 577 M, 813 R, 813 C, 813 L, 815, 816

[56] References Cited

U.S. PATENT DOCUMENTS

| | | | |
|---|---|---|---|
| 2,477,137 | 7/1949 | Mihalek | 74/577 S X |
| 2,968,186 | 1/1961 | Jeanneret | 58/116 R X |
| 3,733,075 | 5/1973 | Hooker et al. | 273/141 A |
| 3,956,941 | 5/1976 | Faivre | 58/116 R X |
| 4,037,845 | 7/1977 | Hooker | 273/138 A |

FOREIGN PATENT DOCUMENTS

| | | | |
|---|---|---|---|
| 969203 | 5/1950 | France | 74/126 |
| 1292712 | 10/1972 | United Kingdom | 273/138 A |

*Primary Examiner*—Vance Y. Hum
*Assistant Examiner*—Arnold W. Kramer
*Attorney, Agent, or Firm*—Fitch, Even & Tabin

[57] ABSTRACT

An amusement apparatus has a plurality of rotary drums, each bearing a plurality of symbols with each symbol being related to an index position. The drums are caused to be rotated then arrested so as to display a combination of symbols having a certain play value. Two solenoid operated pawls are provided whereby an operator may selectively advance the rotation of one of the drums to a fractional rotation equal to one index position.

3 Claims, 5 Drawing Figures

INDEXING MEANS FOR ROTATING DRUMS OF AMUSEMENT APPARATUS

BACKGROUND OF THE INVENTION

In application Serial No. 820,410 there is disclosed a slot machine type amusement apparatus having means for randomly advancing one or more drums bearing symbols, a fraction of a turn, before a playing cycle, so as to cause to be displayed a different combination of symbols, thereby to accord the player an opportunity to win a prize. In a modified embodiment of this concept it is desired that the player have the opportunity to selectively effect rotation of one or more of the drums, each equivalent to only one index position, so that the next in line symbol on a drum is moved into registration with the viewing area of the apparatus. Thus, depending upon the combination of symbols resulting from the previous playing cycle, the player, upon initiating a new playing cycle may selectively effect rotation of one or more of the drums equivalent to one index position for each drum so as to attempt to obtain a winning combination of symbols in the viewing area. It has been found in actual practice that with the use of conventional mechanism it is difficult, if not impossible, to control the operation of the apparatus so that the advance of the drum is limited to only one index position. Accordingly, instead of advancing only a single index position the drum frequently may advance more than one index position which defeats the desired sequence of operations of the apparatus.

SUMMARY OF THE INVENTION

One of the objects of this invention is the provision of means associated with an amusement apparatus of the type described which functions to limit the advance of a symbol bearing drum only to a single index position.

Another object of this invention is the provision of a pair of solenoid operated pawls which operate in synchronism to limit the rotation of an index wheel to a single index position.

Still another object of this invention is the provision of means associated with a rotatable index wheel which when actuated functions to limit the rotation of the wheel to a single index position.

Other and further objects of this invention will become apparent from the following description when the same is considered in connection with the accompanying drawings.

BRIEF DESCRIPTION OF A PREFERRED EMBODIMENT

The amusement apparatus to which the present invention may be applied is described in application Ser. No. 820,410 and includes three rotatable drums, each provided with a peripheral viewing surface on which are displayed a plurality of symbols. The drums are disposed in registration with respective viewing areas through which the symbols are viewed. Fixed to each drum is an index wheel having on its periphery a number of uniformly spaced teeth or recesses, the number of teeth or recesses corresponding to the number of symbols carried on the periphery of the drum. A solenoid operated pawl is associated with each index wheel and when actuated, as described in the above mentioned application, is caused to engage in a recess and to arrest rotation of the drum.

Figure 1:
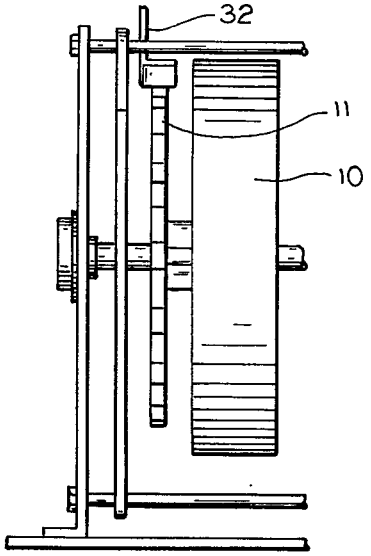
FIG. 1 is a fragmentary front elevational view of a drum and associated ratchet or index wheel constituting parts of an amusement apparatus of the type to which my invention is applicable.
Figure 2:
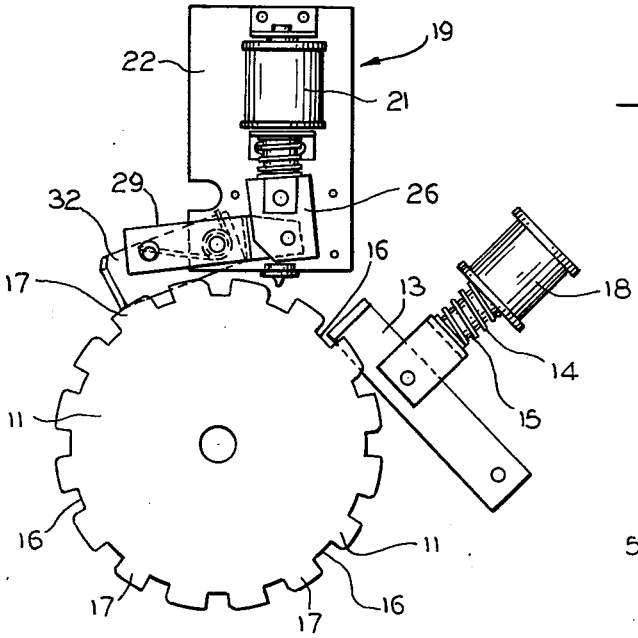
FIG. 2 is a side elevational view showing my invention applied to the index wheel of an amusement apparatus.

Referring to FIG. 1, a single drum 10 and associated index wheel 11 are shown merely to illustrate the invention, although it will be understood that the invention may be applied to one or a plurality of coaxially mounted drums and associated index wheels. Drum 10 and index wheel 11 are driven by motor M through a suitable clutch, not shown. Drum 10 is caused to be operated upon closing of switch 50, which is part of a control mechanism such as described in application Ser. No. 820,410 and is connected in series with index solenoid 18 across power lines 52 and 53. Referring to FIG. 2, a conventional solenoid operated pawl 13 having its distal end bent at a right angle is arranged in cooperative registration with each index wheel 11. Normally, the plunger 15 of the solenoid 18 is biased by a spring 14 so that the distal end of the pawl is engaged in a space 16 between adjacent teeth 17 to hold the drum 10 and index wheel 11 against rotation. When the solenoid 18 is energized the pawl 13 is withdrawn from the space 16 to permit rotation of the index wheel 11. As was hereinabove noted, the use of such a conventional solenoid operated pawl 13 by itself is not reliably effective to limit the rotation of the drum 10 and index wheel 11 only to one position.

In accordance with my invention, I provide a second solenoid operated pawl arrangement, generally indicated at 19, which functions in conjunction with the conventional pawl 13 to effect controlled movement of the index wheel 11.

Figure 4:
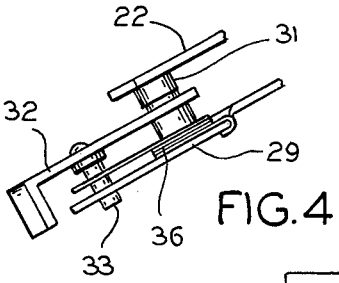
FIG. 4 is a fragmentary plan view taken on line 4—4 of FIG. 3.
Figure 3:
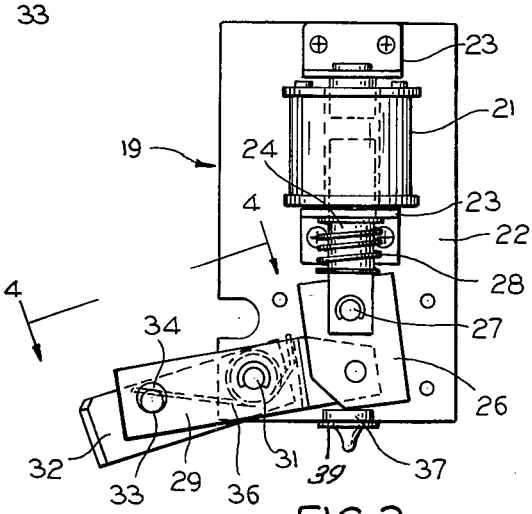
FIG. 3 is a side elevational view of my invention, on an enlarged scale.
Figure 5:
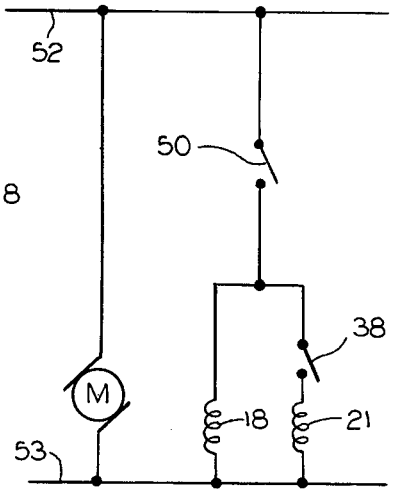
FIG. 5 is a diagrammatic view of the electrical circuit.

Referring to FIGS. 2–4 a solenoid 21 is mounted on a suitable support member 22 disposed in close proximity to an index wheel 11, the coil of the solenoid 21 being retained between two opposed L-shaped brackets 23,23 secured to the support member 22. As seen in FIG. 5 the coil of solenoid 21 is connected in series with a manually operated switch 38 and both the coil and switch are connected in parallel with the coil of solenoid 18. The lower end of the solenoid plunger 24 is bifurcated and a pair of links 26 are disposed between the furcations and pivotally secured thereto by a pin 27. A coil spring 28 circumposed about the plunger 24 and extending between the lower bracket 23 and the links 26 normally biases the plunger 24 to an outward position. The lower ends of the links 26 are pivotally secured to a lever 29 which is rockably supported on a shaft 31 anchored in the support member 22. As seen in FIG. 4 lever 29 has a slightly offset portion for a purpose as will be hereinafter explained. A pawl 32 is pivotally supported on shaft 31. The distal end of pawl 32 is bent at a right angle, as shown clearly in FIG. 4. The pawl 32 carries a pin 33 which extends laterally of the body of the pawl and through an opening 34 in the lever 29, the opening being substantially greater in diameter than the pin so that there is some degree of lost motion between the two parts. A torsion spring 36 is circumposed about the shaft 31 with one end hooked over the lever 29 and the other end engaging the pin 33 so as to normally bias the pawl 32 to a position wherein the pin 33 abuts the bottom of the opening 34, as shown in FIG. 3. As seen in FIG. 4, the offset portion of lever 29 accommodates the torsion spring 36.

A pad 37 of suitable rubber-like material is carried on a lateral extension 39 at the bottom of the support member 22 and serves as a cushion for the links 26 which are normally urged into engagement with the pad 37.

OPERATION

Assuming that a playing cycle has just been completed and the pawl 33 is engaged in a notch 16, substantially as illustrated in FIG. 2, in this position the index wheel 11 and drum 10 are locked against rotation and a symbol on the drum corresponding to the notch is displayed in a viewing area of the apparatus. It will also be noted that in this condition, as seen in FIG. 2, the distal end of the pawl 32 is located slightly above a tooth 17, substantially midway between two consecutive notches 16. Normally the pawl 32 is not in contact with the periphery of the index wheel 11. When switch 50 is closed solenoid coil 18 is energized. Energization of coil 18 will effect withdrawal of pawl 13 from space 16 so that index wheel 11 and drum 10 will rotate until switch 50 is opened by the action of the control mechanism of the apparatus at which point the drum 10 is arrested. If the player, with the intent of advancing drum 10 only one index position, has selectively manually closed switch 38 and the control mechanism thereafter operates a close switch 50, then solenoid coils 18 and 21 are energized. Energization of solenoid coil 21 will effect rocking of the pawl 32 in a counterclockwise direction, as viewed in FIG. 2, so that the pawl 32 engages the periphery of the index wheel 11 and as the index wheel rotates, the pawl 32 will engage in the first space 16 which moves into registration with the pawl, thereby locking the index wheel 11 against rotation. In effect the index wheel has moved the equivalent of one-half index position.

It should be noted that when pawl 32 is engaged in a space 16 pawl 13 is disposed in registration with a tooth 17, substantially in the middle thereof but out of contract therewith. When the switch 50 is opened both solenoid coils 18 and 21, are deenergized and the respective springs 14 and 28 cause the plungers 15 and 24 to move outwardly thereby effecting withdrawal of pawl 32 from a space 16 and effecting engagement of pawl 13 in a space 16 immediately following the tooth 17 with which it was last in registration. Thus, the index wheel 11 is immediately arrested after moving the equivalent of one-half index position so that the next succeeding symbol on the drum 10 is moved into the viewing area of the apparatus.

Various changes coming within the spirit of my invention may suggest themselves to those skilled in the art; hence, I do not wish to be limited to specific embodiments shown and described or uses mentioned, but intend the same to be merely exemplary, the scope of my invention being limited only by the appended claims.

I claim:

1. In an amusement apparatus including a plurality of rotatable drums, each having a plurality of symbols and each symbol being related to an index position on an index wheel connected to the drum, said index wheel having uniformly spaced peripheral teeth and spaces between said teeth, certain combinations of said symbols entitling a player to a reward, a clutch in driving engagement with one drum, a motor for driving said one drum through said clutch, a first solenoid operated pawl having its distal end normally biased into engagement in a space on said index wheel of said one drum to lock said index wheel against rotation, and first switch means for energizing upon actuation said first solenoid operated pawl, the improvement which comprises a second solenoid operated pawl having its distal end normally biased out of engagement with the periphery of said index wheel of said one drum but in registration with a point disposed substantially medially of one of said teeth when the distal end of said first solenoid operated pawl is in engagement in one of said spaces, and second switch means connected to said second solenoid operated pawl so as to energize said second solenoid operated pawl only upon actuation of both said first and second switch means, whereby if both switch means are actuated the index wheel is driven by the motor a distance substantially equal to one-half the width of an index tooth before being locked by said second solenoid operated pawl and on subsequent deactuation of said first switch means the index wheel is driven by said motor an additional distance substantially equal to one-half of the width of an index tooth before being locked by said first solenoid operated pawl so that the total advance is one index position.

2. The invention as defined in claim 1 in which the second solenoid operated pawl comprises a coil, a plunger, a lever pivotally supported intermediate its ends on a shaft, a link connecting said plunger and one end of said lever, a pawl pivotally supported on said shaft substantially parallel to said lever, said lever having an opening, a pin carried on said pawl and extending laterally through said opening, the pin being smaller than said opening so as to afford limited relative movement between said lever and said pawl and spring means biasing said pawl in a direction wherein the pin engages a side of said opening.

3. A solenoid operated pawl comprising a coil, a plunger, a lever pivotally supported intermediate its ends on a shaft, a link connecting said plunger and one end of said lever, a pawl pivotally supported on said shaft substantially parallel to said lever, said lever having an opening, a pin carried on said pawl and extending laterally through said opening, the pin being smaller than said opening so as to afford limited relative movement between said lever and said pawl and spring means biasing said pawl in a direction wherein the pin engages a side of said opening.

* * * * *

UNITED STATES PATENT AND TRADEMARK OFFICE

CERTIFICATE OF CORRECTION

PATENT NO. : 4,191,377

DATED : March 4, 1980

INVENTOR(S) : Walter M. Burnside

It is certified that error appears in the above-identified patent and that said Letters Patent are hereby corrected as shown below:

Column 1, line 26, change "mechanism" to --mechanisms--.

Column 3, line 18, change "33" to --13--.

Column 3, lines 49-50, change "contract" to --contact--.

Signed and Sealed this

*Second* Day of *September 1980*

[SEAL]

*Attest:*

SIDNEY A. DIAMOND

*Attesting Officer*

*Commissioner of Patents and Trademarks*